US012065827B2

(12) United States Patent
Harber et al.

(10) Patent No.: US 12,065,827 B2
(45) Date of Patent: Aug. 20, 2024

(54) PANEL CONTAINMENT SYSTEM AND RELATED METHODS

(71) Applicant: Abatement Technologies, Inc., Suwanee, GA (US)

(72) Inventors: Blair Lawrence Harber, St. Davids (CA); Adam Brian Hunninck, Stevensville (CA)

(73) Assignee: ABATEMENT TECHNOLOGIES, INC., Suwanee, GA (US)

( * ) Notice: Subject to any disclaimer, the term of this patent is extended or adjusted under 35 U.S.C. 154(b) by 206 days.

(21) Appl. No.: 17/666,895

(22) Filed: Feb. 8, 2022

(65) Prior Publication Data

US 2022/0251833 A1 Aug. 11, 2022

Related U.S. Application Data

(60) Provisional application No. 63/147,487, filed on Feb. 9, 2021.

(51) Int. Cl.
*E04B 2/74* (2006.01)
*E04B 2/72* (2006.01)

(52) U.S. Cl.
CPC ..... *E04B 2/7448* (2013.01); *E04B 2/721* (2013.01); *E04B 2/7409* (2013.01); *E04B 2/7429* (2013.01); *E04B 2002/7498* (2013.01)

(58) Field of Classification Search
CPC .... E04B 2/7429; E04B 2/7427; E04B 2/7405; E04B 2/7448; E04B 2/7453; E04B 202/7498
See application file for complete search history.

(56) References Cited

U.S. PATENT DOCUMENTS 3,889,736 A * 6/1975 Firks ..... E04B 2/7429 16/225
4,344,475 A * 8/1982 Frey ..... A47G 5/00 16/225
4,777,777 A * 10/1988 Massimo ..... F16B 5/0052 16/382
5,339,576 A * 8/1994 Fussler ..... E04B 2/7429 52/282.1
5,450,694 A * 9/1995 Goranson ..... E04B 2/7429 52/71
10,329,760 B2 6/2019 Harber et al.

* cited by examiner

*Primary Examiner* — Kyle J. Walraed-Sullivan
(74) *Attorney, Agent, or Firm* — Kilpatrick Townsend & Stockton LLP

(57) ABSTRACT

A containment system for separating a containment area from an external environment may include one or more panel assemblies, various types of door assemblies, a flexible corner assembly, and other components that form a modular system capable of adapting to various configurations using a minimal number of fasteners, brackets, and/or clamps.

8 Claims, 14 Drawing Sheets

PANEL CONTAINMENT SYSTEM AND RELATED METHODS

REFERENCE TO RELATED APPLICATION

This application claims the benefit of U.S. Provisional Patent Application No. 63/147,487, filed on Feb. 9, 2021 and entitled PANEL CONTAINMENT SYSTEM AND RELATED METHODS, the content of which is hereby incorporated by reference in its entirety.

FIELD OF THE INVENTION

This application relates to devices and methods for facilitating maintenance and service operations while providing air filtration to contain and capture hazardous and/or non-hazardous particulate, biological, and gas phase contaminants released into the air as a result of these activities.

BACKGROUND

Buildings including but not limited to healthcare facilities, laboratories, and hospitals may have areas that cannot be regularly cleaned, such as within walls, below floors, or above ceilings, but that must be accessed during various tasks such as construction, renovations, and maintenance. Certain facilities including but not limited to healthcare facilities, laboratories, and hospitals may include requirements related to cleanliness and minimizing hazardous airborne contaminants. For example, healthcare facilities may have various cleanliness requirements to minimize the risk of hospital-acquired infections caused by hazardous airborne contaminants.

The design of products, such as containment systems, that limit airflow into or out of specific areas, quarantine sites, and/or facilitate access to potentially contaminated areas in sensitive environments is challenging because there are a large number of demanding requirements and desired features, some of which compete with each other. While some containment systems have been implemented in the past, such systems typically include several disadvantages. For example, existing systems typically expose fragile components to potential impacts and abrasion with adjacent objects, have parts that are not interchangeable, have parts that cannot accommodate non-planar floors or ceilings, and/or rely on a perfectly flat surface to form a seal.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments, a containment system for separating a containment area from an external environment includes a flexible corner assembly that is configured to join adjacent panel assemblies of the containment system. The flexible corner assembly includes a corner body having a first face, a second face opposite from the first face, a first projection, a second projection, and at least one bending groove. In certain embodiments, the first projection extends outwards from the first face and along a length of the corner body, and the second projection extends outwards from the second face in a direction opposite the first projection and along the length of the corner body. The second projection may be offset from the first projection in a lateral direction on the corner body. The at least one bending groove is defined in the corner body between the first projection and the second projection in the lateral direction, and the at least one bending groove extends along the length of the corner body. In various embodiments, the corner body is bendable via the at least one bending groove such that an orientation of the first projection relative to the second projection is adjustable.

According to some embodiments, a containment system for separating a containment area from an external environment includes a strut and a panel. The strut includes a channel that extends along a length of the strut. The panel includes a body portion and an edge portion, and the body portion and the edge portion define a panel cavity. The edge portion is at least partially received within the channel of the strut. A width of the edge portion is less than a width of the body portion, and the width of the body portion is less than a width of the strut.

According to certain embodiments, a containment system for separating a containment area from an external environment includes a door frame, a track, and a door carriage. The door frame defines an opening, and the track extends across the opening. The track includes a first end and a second end, and a vertical height of the first end is different from a vertical height of the second end such that the track is sloped downwards towards the first end or the second end. The door carriage is configured to support a door and includes at least one roller that is movable along the track, a support, and at least one vertical adjuster. The at least one vertical adjuster extends from the support and is configured to engage the door, and the at least one vertical adjuster is vertically adjustable such that a distance between the door and the support is adjustable.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
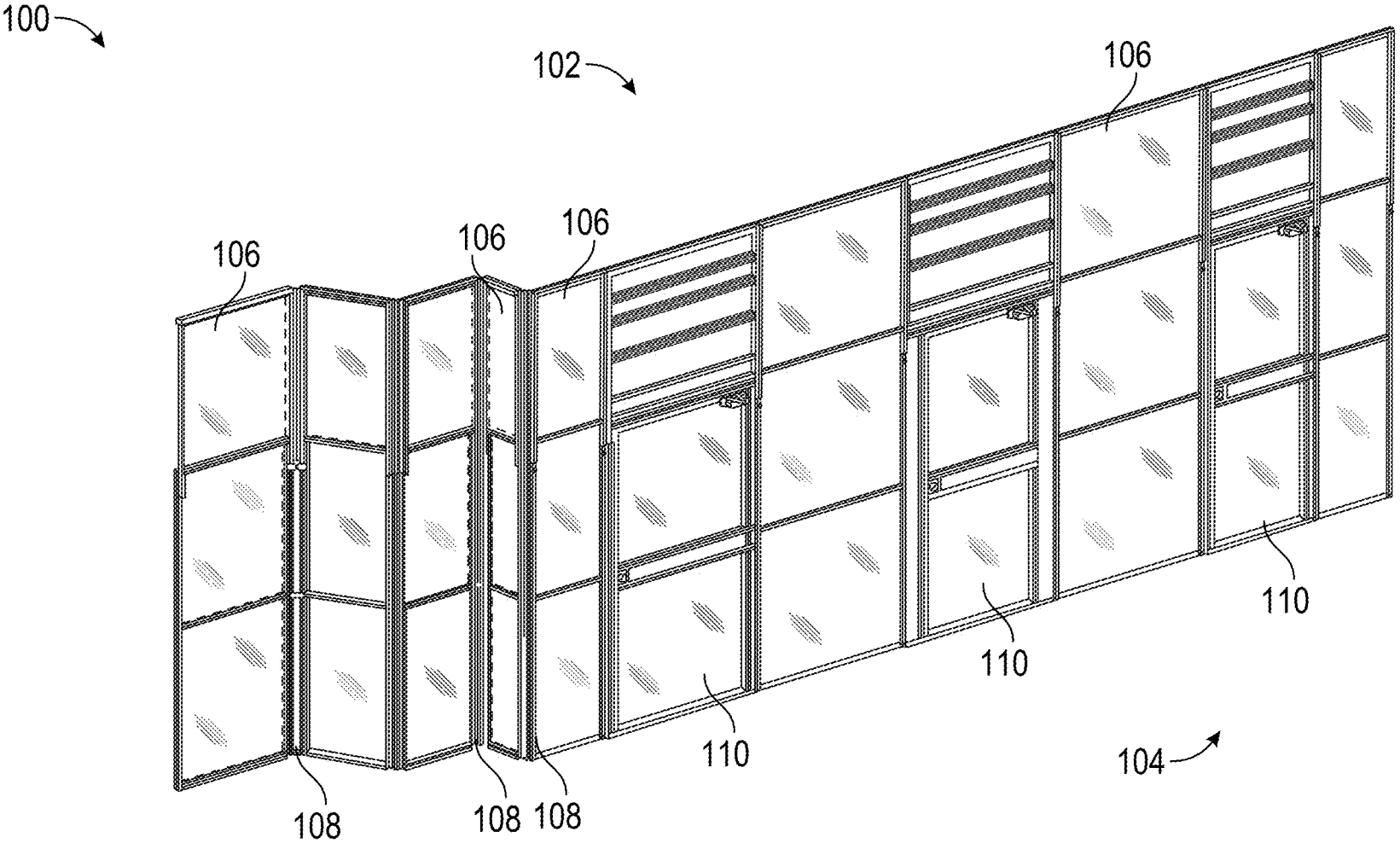
FIG. 1 is a perspective view of a containment system according to various embodiments.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others are intended to refer to the orientation as illustrated and described in the figure (or figures) to which the components and directions are referencing but are not intended to imply any particular configuration. Throughout this disclosure, a reference numeral with a letter refers to a specific instance of an element and the reference numeral letter without a letter refers to the element generically or collectively. Thus, as an example (not shown in the drawings), device "12A" refers to an instance of a device class, which may be referred to collectively as devices "12" and any one of which may be referred to generically as a device "12".

Described herein are containment systems that may facilitate isolation of a containment area adjacent to the containment system from another area, such as an external environment. The containment systems described herein may be utilized during various tasks, including but not limited to maintenance, renovation, and/or construction. In some cases, the containment systems create a barrier between the containment area and the external environment. The containment area may include a workspace or an enclosed area (i.e., an area where contaminants should be contained). In certain embodiments, the containment systems can be adjusted to define an area of adjustable size and/or shape to limit access to and provide a seal between the containment area and the external environment. The containment systems described herein are modular so that the necessary modules can be attached to one another to create the desired containment area. Each module or component (i.e., panel assembly, corner assembly, door assembly, etc.) is designed with an interior side (configured to be in the containment area) and an exterior side opposite of the interior side facing the external environment. In certain embodiments, the containment systems described herein and the various subassemblies may be, but do not have to be, used in conjunction with and/or include features similar to containments systems such as those shown and described in U.S. Applicant Ser. No. 15/909,278, filed on Mar. 1, 2018 and entitled RIGID PANEL CONTAINMENT SYSTEM AND RELATED METHODS ("the '278 Application"), the content of which is hereby incorporated by reference in its entirety.

In certain embodiments, the containment systems described herein may include a flexible corner assembly that may be used to join adjacent panel assemblies of the containment system. The flexible corner assembly may allow for improved flexibility of the containment system to form different sized containment areas and/or to be in various configurations as desired. In various aspects, the flexible corner assembly may allow for improved adjustment of the containment system such that one panel assembly can be adjusted to various orientations relative to another panel assembly after the panel assemblies are joined via the flexible corner assembly. In certain aspects, the flexible corner assembly may form and/or maintain a seal between the adjacent panel assemblies.

The containment systems described herein may also allow the containment system to provide improved performance via a hollow panel assembly or a panel assembly having a panel with a panel cavity. The panel with the panel cavity may allow various material to be included with the containment system as desired, including but not limited to thermal insulation, acoustical insulation, various optical features, or as otherwise desired.

In some examples, the containment systems described herein may provide door assemblies that optionally bias a door of the containment system to a closed position relative to a door opening. Such biasing may provide improved performance of the containment system to separate the containment area from the external environment by minimizing or reducing the opportunities for the door opening to be unintentionally left uncovered. Various other benefits and improvements may be realized with the containment system described herein, and the aforementioned examples should not be considered limiting.

FIGS. 1-22 illustrate an example of a containment system 100 according to various embodiments. The containment system 100 may be used for various tasks, including but not limited to maintenance, renovation, or construction to facilitate isolation of a containment area 102 from an external environment 104. The containment system 100 includes one or more panel assemblies 106, one or more corner assemblies 108, and optionally one or more door assemblies 110, one or more exhaust panel assemblies, one or more wall seal assemblies, and/or other components that together form a modular system that is adaptable to various configurations using a minimal number of fasteners, brackets, and/or clamps. In certain embodiments, one or more panel assemblies 106, one or more corner assemblies 108, one or more door assemblies 110, one or more exhaust panel assemblies, one or more intersections, one or more wall seal assemblies, and/or other components may be, but do not have to be, substantially similar to those described in the '928 Application. As some non-limiting examples, one or more components may be height-adjustable and/or may have various widths.

In some examples, the containment system 100 is configured to meet various standards provided in publications from organizations including the Canadian Standards Association (CSA) and/or the Centers of Disease Control and Prevention (CDC). As one non-limiting example, the containment system may be designed to meet the standards of (1) CSA Z317.13—Infection Control during Construction, Renovation, and Maintenance of Health Care Facilities or (2) Guidelines for Environmental Infection Control in Health-Care Facilities: Recommendations of CDC and the Healthcare Infection Control Practices Advisory Committee (HICPAC).

Figure 2:
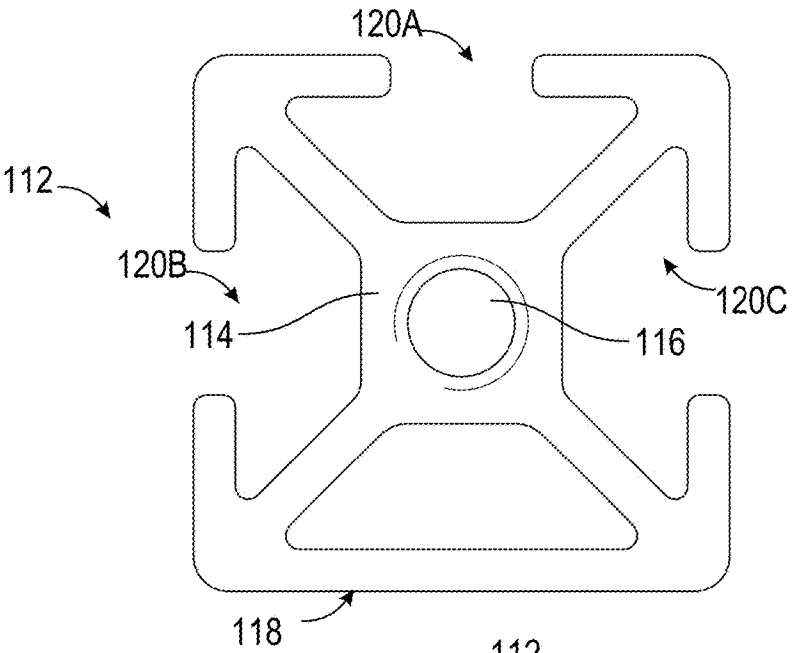
FIG. 2 is an end view of a strut of the containment system of FIG. 1.

Referring to FIG. 2, the various assemblies and subcomponents of the containment system 100 may be constructed using one or more sections of a strut 112. The strut 112 may be metallic, thermoplastic, composite, or any other appropriate material or combination of materials as desired. The strut 112 may include a central hub 114 with an aperture 116. The aperture 116 may be present at one or both ends of the strut and, in some cases, may be threaded. In other embodiments, the aperture 116 may be omitted. The outer surface of the strut 112 includes at least one channel 120, and in certain embodiments, the outer surface of the strut 112 includes a plurality of channels 120. The strut 112 may likewise have various cross-sectional shapes as desired. In the embodiment illustrated in FIG. 2, the outer surface of the strut 112 has a generally square cross-section and may include one side with a continuous surface 118. The strut 112 in FIG. 2 also has three sides with channels including a first channel 120A opposite the continuous surface 118 and second and third channels 120B-C on faces adjacent the continuous surface 118.

In some examples, various subcomponents of the containment system 100 are constructed using struts 112 such that each such member includes a central hub 114, one or more apertures 116, and multiple channels 120 extending along its respective length. In addition, although not illustrated, each member may include a compressible member inserted into at least one of the channels along the length of the member. For example, a strip of foam may be inserted into at least one of the channels. In some cases, the compressible member may be large enough to occupy most of the channel and protrude through the opening of the channel. In some examples, a portion of another component, such as a panel assembly and/or door assembly, may be inserted into a channel with a compressible member such that the compressible member compresses and/or deforms around the component within the channel. The compressible member thus creates a tight secure fit of the component within the channel and reduces movement, rattling, vibration, abrasion, etc. of the component around its perimeter.

Corner Assemblies

As illustrated in FIG. 1, a corner assembly 108 may join at least two adjacent components (e.g., adjacent panel assemblies 106, a panel assembly 106 and a door assembly 110, etc.) In certain embodiments, the corner assemblies may be those described in the '278 Application. In some embodiments, and as best illustrated in FIGS. 3-7, at least one of the corner assemblies 108 is a flexible corner assembly 308 having a corner body 322. The corner body 322 may be constructed from various suitable bendable or flexible materials as desired such that a configuration of the corner body 322 is adjustable, and is optionally constructed from various materials suitable for forming a seal. In some non-limiting embodiments, the corner body 322 is constructed from a rubber or a polymer. In various embodiments, the corner body 322 is optionally monolithically or integrally formed as a single component. In such embodiments, the corner body 322 may be a continuous component that minimizes or eliminates potential breaks in a seal formed with the corner body 322.

Figure 4:
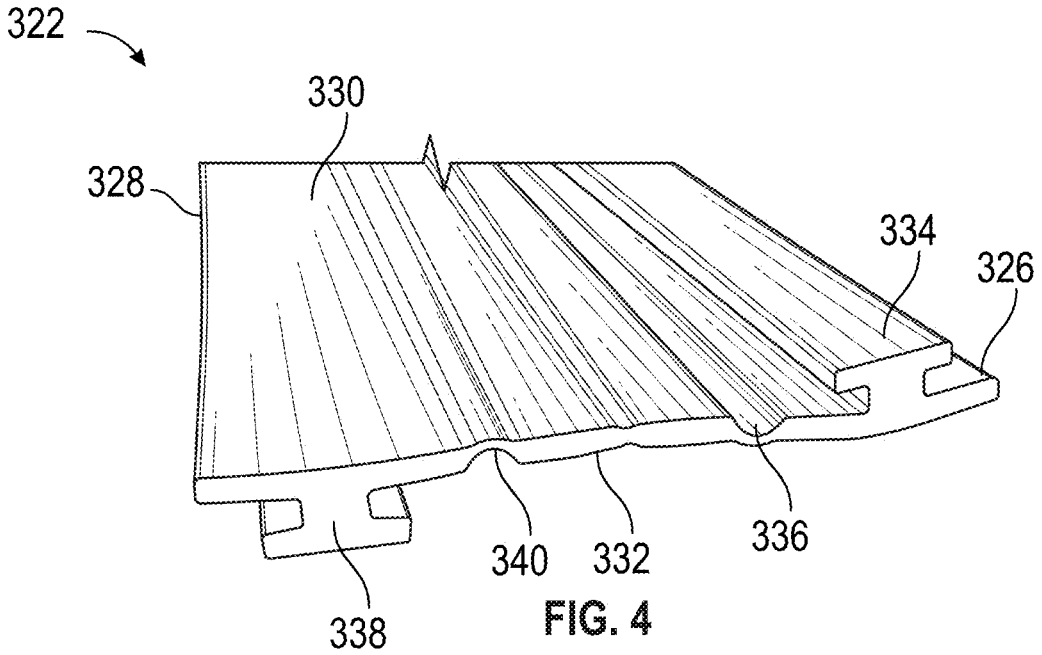
FIG. 4 is a perspective view of a corner body of the flexible corner assembly of FIG. 3.

Referring to FIG. 4, the corner body 322 includes a first edge 326, a second edge 328, a first face 330, and a second face 332 opposite from the first face 330. A distance between the first edge 326 and the second edge 328 is a width of the corner body 322 and defines a lateral direction. A length or longitudinal direction of the corner body 322 is transverse to the lateral direction.

In various embodiments, the first face 330 includes at least one projection 334 extending outwards from the first face 330 between the first edge 326 and the second edge 328 that is configured to be positioned in a channel 120 of a strut 112. The first face 330 also includes at least one groove 336 defined in the first face 330 between the first edge 326 and the second edge 328 that defines a bending location for the corner body 322. In certain embodiments, the projection 334 and the groove 336 extend along the length of the corner body 310, although in other embodiments they need not extend along the entire length. In some embodiments, and as illustrated in FIG. 4, the projection 334 and the groove 336 may be positioned more proximate to one edge of the corner body (e.g., the first edge 326) than the opposing edge such that the projection 334 and the groove 336 are not centered on the first face 330 in the lateral direction. In various embodiments, the projection 334 extends from the first face 330 at a lateral direction that is between the groove 336 and the first edge 326. However, the particular locations of the projection 334 and the groove 336 should not be considered limiting. Moreover, while a single projection 334 and a single groove 336 are illustrated on the first face 330, in various embodiments, the first face 330 may include any number of projections 334 and/or grooves 336 as desired.

In certain embodiments, the second face 332 includes at least one projection 338 extending outwards from the second face 332 between the first edge 326 and the second edge 328 that is configured to be positioned in a channel 120 of a strut 112. The second face 332 also includes at least one groove 340 defined in the first face 330 between the first edge 326 and the second edge 328 that defines a bending location for the corner body 322. In certain embodiments, the projection 338 and the groove 340 extend along the length of the corner body 310, although in other embodiments they need not extend along the entire length. In some embodiments, and as illustrated in FIG. 4, the projection 338 and the groove 340 may be positioned more proximate to one edge of the corner body (e.g., the second edge 328) than the opposing edge such that the projection 338 and the groove 340 are not centered on the second face 332 in the lateral direction. In certain embodiments, the projection 338 and the groove 340 may be laterally offset from the projection 334 and the groove 336 of the first face 330. In various embodiments, the projection 338 extends from the second face 332 at a lateral direction that is between the groove 340 and the second edge 328. However, the particular locations of the projection 338 and the groove 340 should not be considered limiting. Moreover, while a single projection 338 and a single groove 340 are illustrated on the second face 332, in various embodiments, the second face 332 may include any number of projections 338 and/or grooves 340 as desired.

Optionally, the flexible corner assembly 308 may also include a cover 324. Similar to the corner body 322, the cover 324 may be constructed from various bendable for flexible materials such that the configuration of the cover 324 is adjustable. In some non-limiting examples, the cover 324 is constructed from a rubber or a polymer, which optionally may be different from the material of the corner body 322. Similar to the corner body 322, the cover 324 may optionally be monolithically or integrally formed as a single or continuous component.

Figure 5:
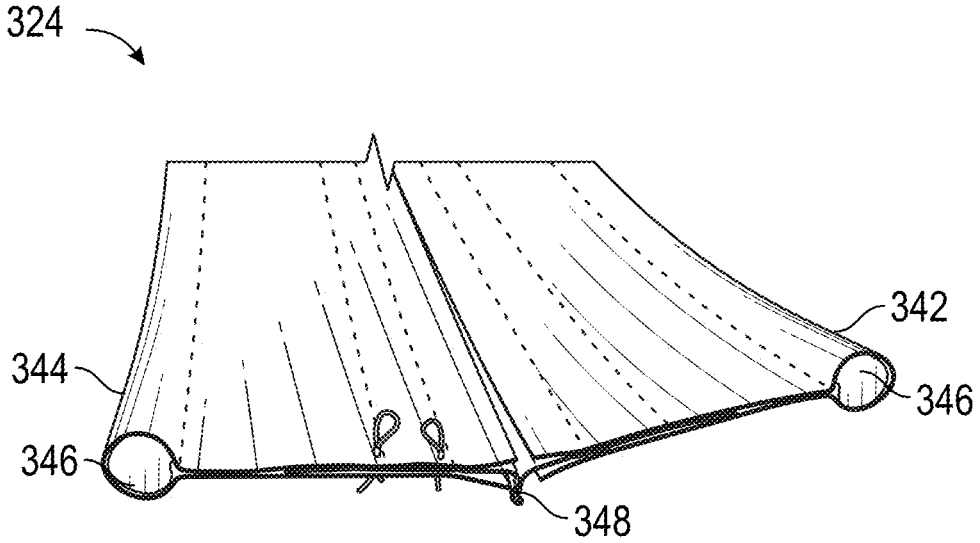
FIG. 5 is a perspective view of a cover of the flexible corner assembly of FIG. 3.

Referring to FIG. 5, when included, the cover 324 includes a first edge 342 and a second edge 344 opposite from the first edge 342. Each edge 342, 344 may include a rib 346 as an engagement feature that is positionable within a channel 120 of a strut 112. Optionally, the rib 346 may form a seal with the strut 112. While a rib 346 is illustrated as the engagement feature, in other embodiments, the rib 346 may be omitted and/or various other elements or components may be provided as engagement features. As such, the rib 346 should not be considered limiting. In some embodiments, the cover 324 includes at least one spacer 348 that extends outwards from the cover 324 between the edges 342, 344. The spacer 348 may selectively contact the corner body 322 and/or another component of the containment system 100 (e.g., a strut 112) to space the cover 324 apart from the corner body 322 and/or other component. In the embodiment of FIG. 5, the cover 324 includes a single spacer 248; however, in other embodiments, a plurality of spacers 348 may be provided, and the spacers 348 optionally may be provided on opposing faces.

Figure 3:
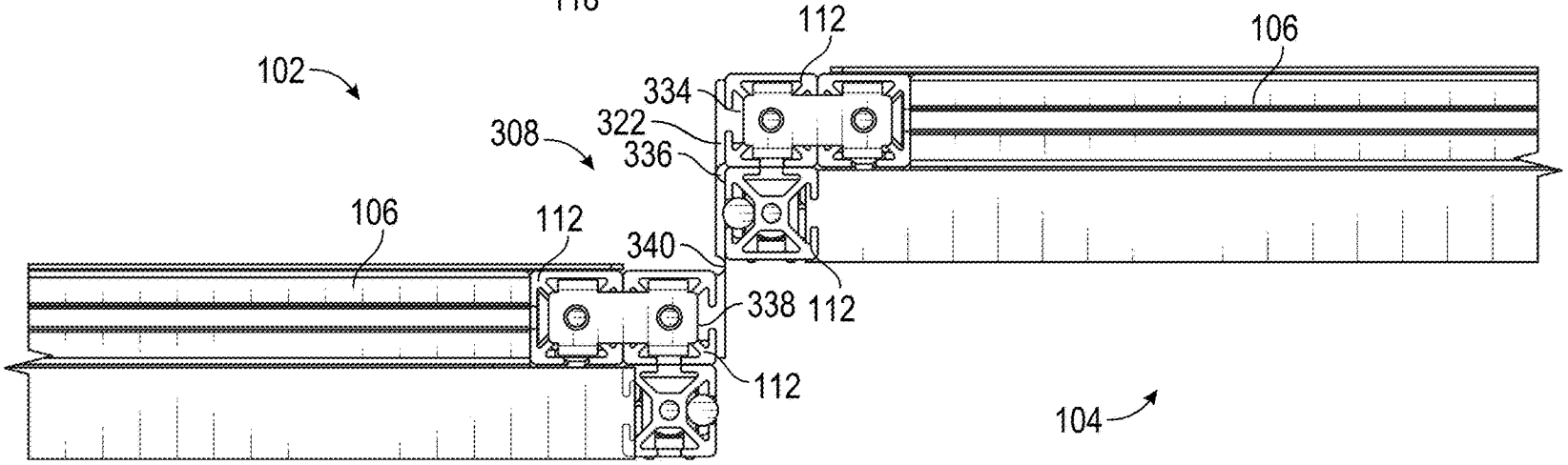
FIG. 3 is a top view of adjacent panel assemblies of the containment system of FIG. 1 with a flexible corner assembly according to certain embodiments.
Figure 6:
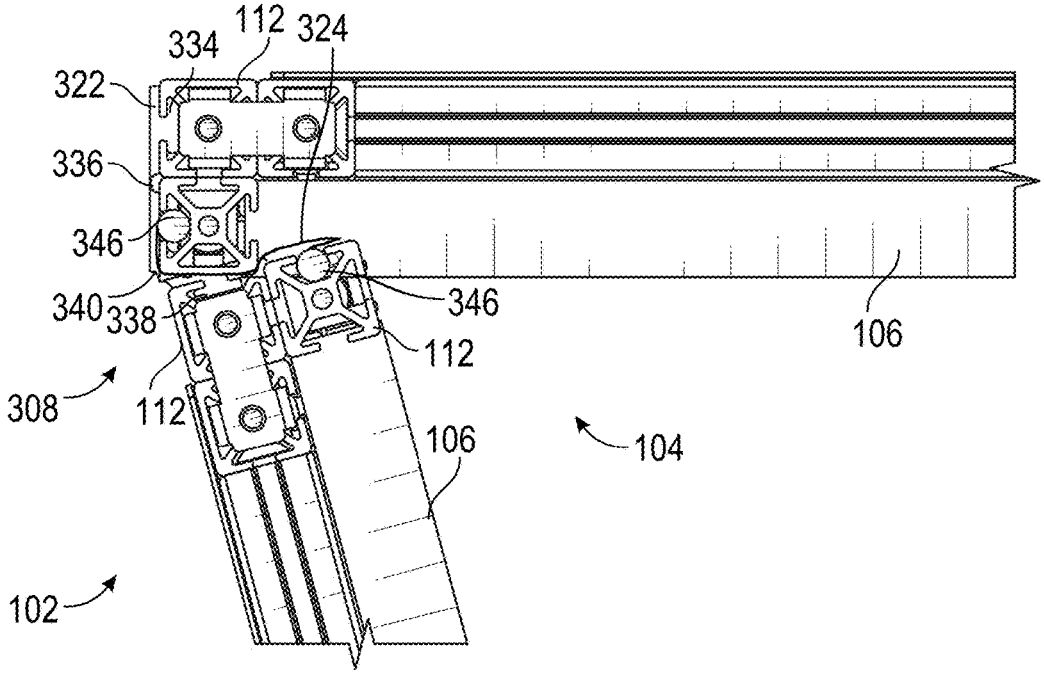
FIG. 6 is a top view of the adjacent panel assemblies and flexible corner assembly of FIG. 3 with the panel assemblies in an angled orientation.
Figure 7:
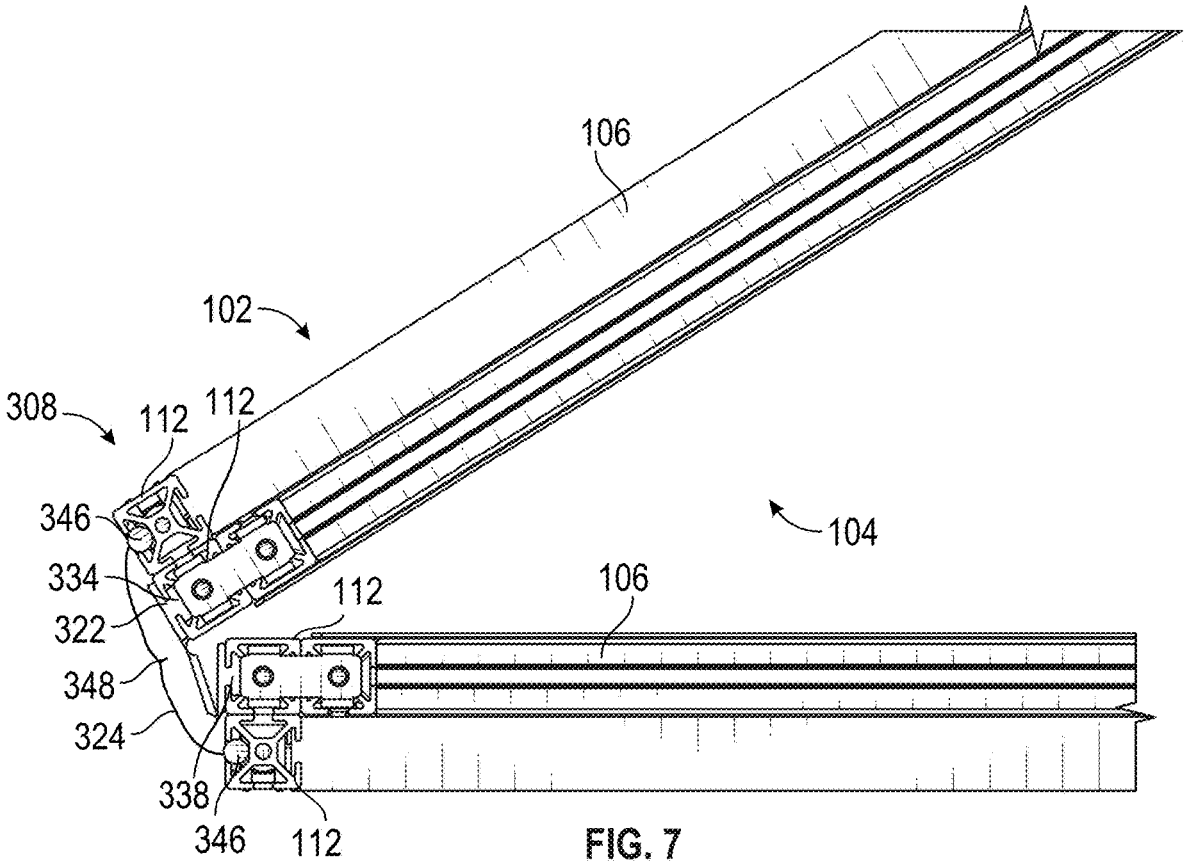
FIG. 7 is a top view of the adjacent panel assemblies and flexible corner assembly of FIG. 3 with the panel assemblies in another angled orientation.

Referring to FIGS. 3, 6, and 7, the flexible corner assembly 308 may join adjacent components of the containment system 100 and optionally forms a seal at the interfaces between the adjacent components. In FIGS. 3, 6, and 7, the adjacent components illustrated are adjacent panel assemblies 106. As illustrated in FIG. 3, for example, to assemble the flexible corner assembly 308 with the panel assemblies 106 and form the sealed joint area, the projection 334 of the first face 330 is positioned in a channel 120 of a strut 112 of one of the panel assemblies 106 and the projection 338 of the second face 332 is positioned in a channel 120 of a strut 112 of the other panel assembly 106. In this manner, the corner body 322 may span and cover the space between the adjacent panel assemblies 106. When included, the cover 324 may be assembled with the adjacent panel assemblies 106 by positioning the ribs 346 (and/or other engagement features) in the channels 120 of the struts 112 of the panel assemblies 106 such that the cover 324 at least partially overlaps the corner body 322. The ribs 346 may be positioned in channels 120 of the struts 112 that are different from those that receive the projections 334, 338.

In certain embodiments, the projections 334, 338 on the opposing faces 330, 332 of the corner body 322 may allow for the panel assemblies 106 to be positioned in and/or moved from a neutral orientation (FIG. 3) to one or more angled configurations, such as those illustrated in FIGS. 6 and 7, while the flexible corner assembly 308 is assembled with the panel assemblies 106. Such movement while assembled may optionally maintain a sealed joint region while the panel assemblies 106 are positioned at their desired orientation and/or may provide additional orientations for the panel assemblies 106 such that the containment system 100 has a desired shape or orientation as desired.

Referring to FIG. 3, in the neutral orientation, the panel assemblies 106 (or other components of the containment system 100) may be generally parallel to each other, and the corner body 322 of the flexible corner assembly 308 may be unbent. In other words, the first face 330 and the second face 332 may face in opposing directions.

From the neutral orientation, the flexible corner assembly 308 may allow for positioning of the panel assemblies by bending the corner body 322 via the groove 336 and/or the groove 340 to an angled orientation. In certain embodiments, to move the panel assemblies from the neutral orientation to one or more angled orientations, one panel assembly 106 may optionally be held stationary while the other panel assembly 106 is optionally rotated and/or swung inwards or outwards (e.g., towards the containment area or away from the containment area) about the flexible corner assembly 308.

In various aspects, in the angled orientation, the panel assemblies 106 extend at a non-zero angle relative to each other and the corner body 322 is bent. In certain embodiments, the corner body 322 is bent such that at least a first portion of the corner body 322 extends at a non-zero angle relative to a second portion of the corner body 322. In certain embodiments, the non-zero angle is less than or equal to 150 degrees from the neutral orientation. In some cases, the corner body 322 is bent such that at least a portion of the first face 330 faces a direction that is different from the direction of another portion of the first face 330. Likewise, the corner body 322 may be bent such that at least a portion of the second face 332 faces a direction that is different from the direction of another portion of the second face 332. Optionally, the corner body 322 may be bent such that at least a portion of the first face 330 faces and/or overlaps a portion of the second face 332 (or vice versa). FIGS. 6 and 7 illustrate two different examples of the angled orientation, and other angled orientations may be achieved as desired by rotating either panel assembly 106.

Panel Assemblies

The panel assemblies 106 of the containment system 100 may be those described in the '278 Application and may include various frame members, edge members, panels, and other components as desired. The panel assemblies 106 may be may be constructed from materials that are rigid or semi-rigid including but not limited to metal, polycarbonate, plastic, or composite materials. The panel assemblies 106 may be transparent, translucent, opaque, have other optical finishes as desired, or a combination thereof. The panel assemblies 106 may also include feature(s) related to thermal and/or acoustical insulation. In some examples, the features include gypsum wall board, at least one metallic layer on the interior and/or exterior side of the module, and/or any other necessary thermal insulation and/or acoustical insulation. For example, outer metallic layers may sandwich insulation (along with the structural components of the module) between the metallic layers. Such arrangements would allow the containment system 100 to meet fire rating standards and/or noise exposure standards.

Figure 8:
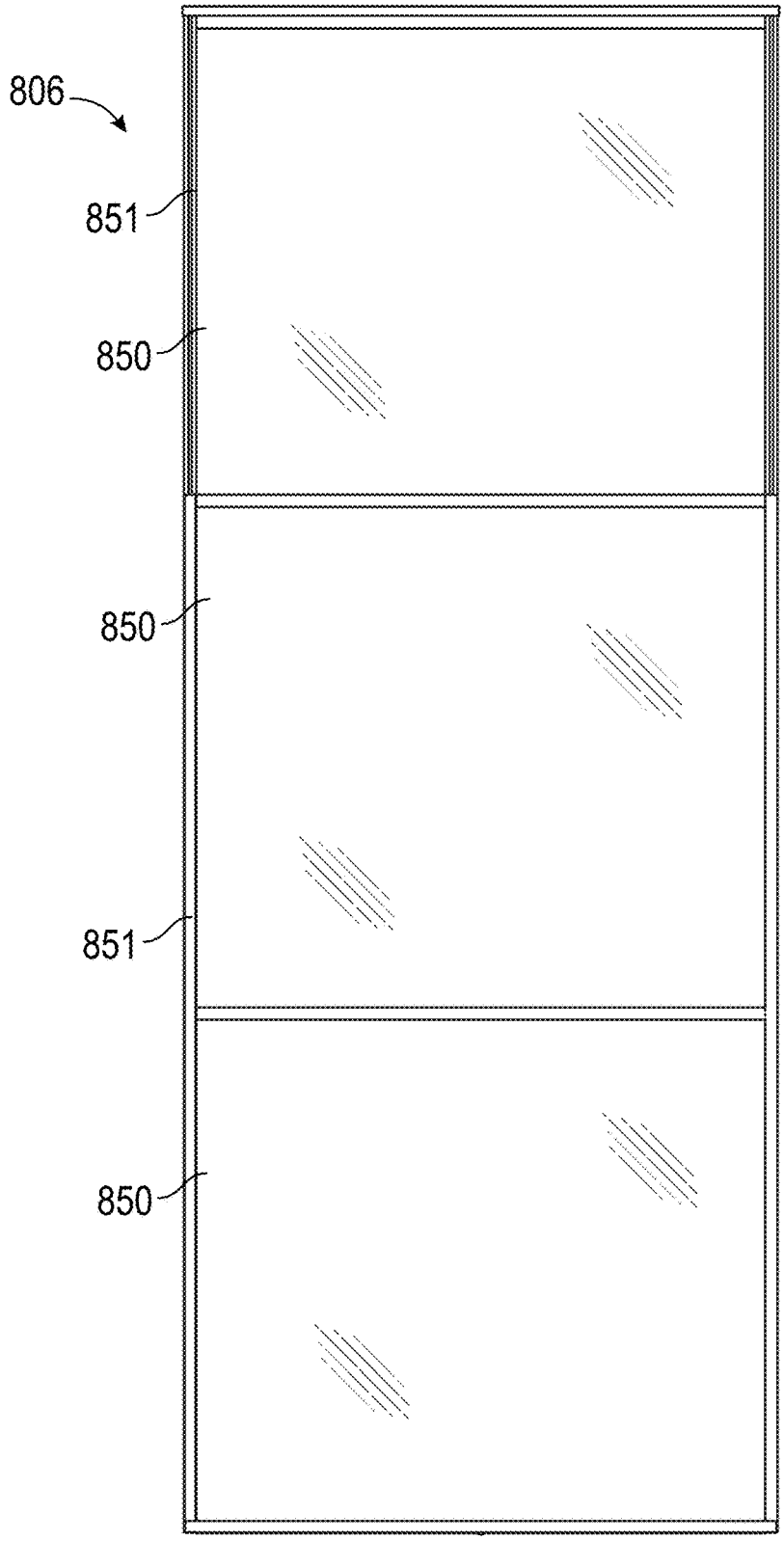
FIG. 8 is a front view of a panel assembly for the containment system of FIG. 1 according to certain embodiments.
Figure 9:
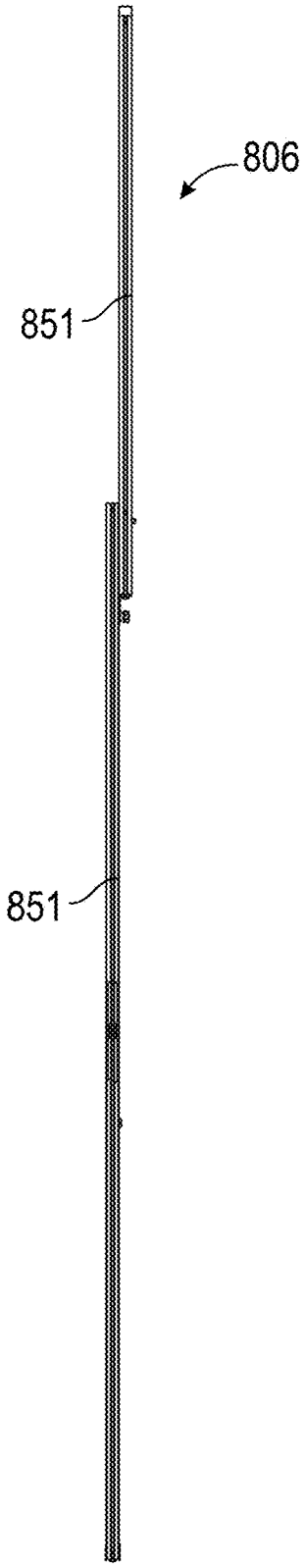
FIG. 9 is a side view of the panel assembly of FIG. 8.
Figure 10:
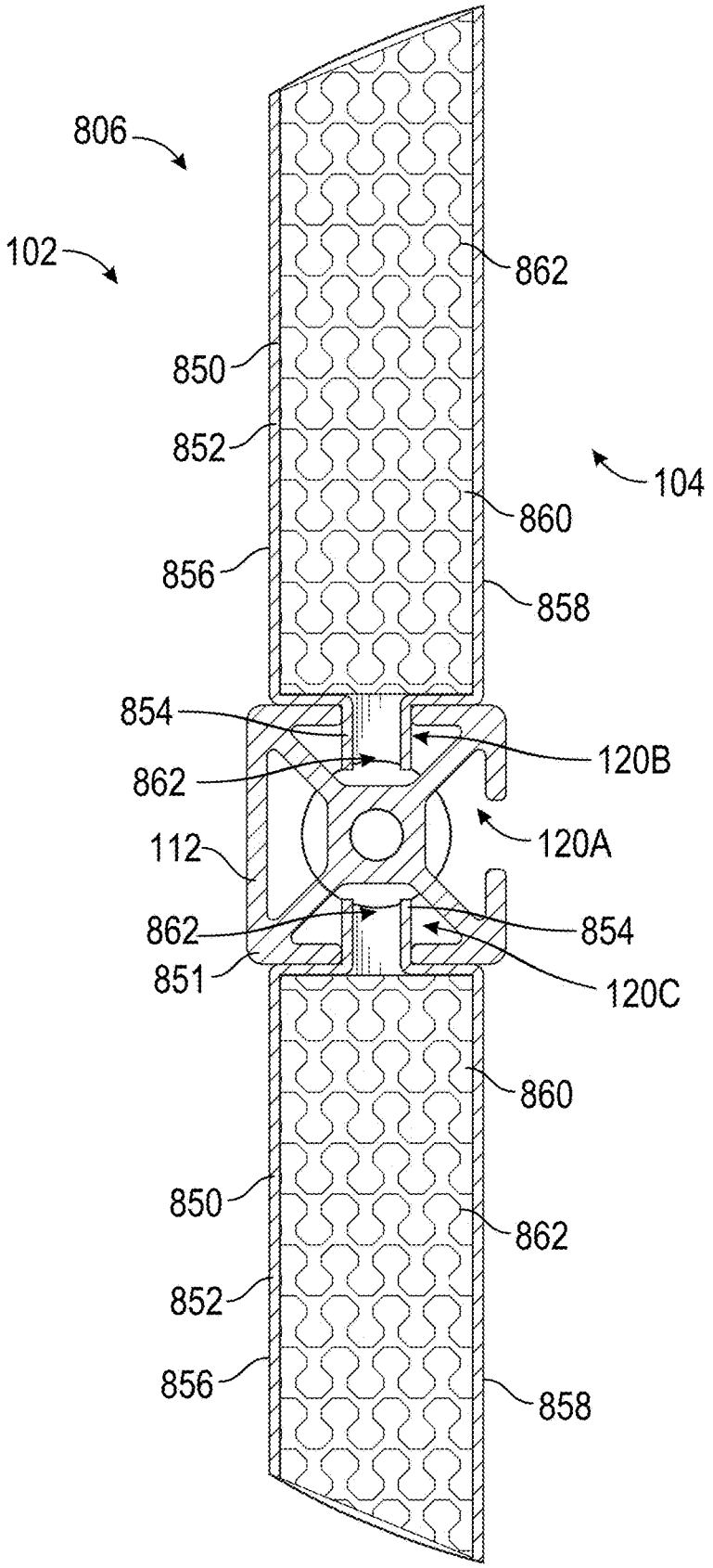
FIG. 10 is a sectional view of a portion of the panel assembly of FIG. 7.

In some embodiments, and as best illustrated in FIGS. 8-10, at least one of the panel assemblies 106 is a panel assembly 806 having at least one hollow panel 850 supported by at least one frame member 851. In certain embodiments, the frame member 851 may include the strut 112. In the example of FIGS. 8-10, the panel assembly 806 includes three hollow panels 850, although the number of hollow panels 850 should not be considered limiting. In certain aspects, the panel assembly 806 may include at least one panel that is not hollow. In the embodiment illustrated, at least the top-most panel 850 is vertically adjustable (e.g., via frame members 851) such that a height of the panel assembly 806 is adjustable. The panels 850 may be supported by struts 112 and/or other fame members or components as desired, including but not limited to those described in the '278 Application.

As best illustrated in FIG. 10, each hollow panel 850 includes a body portion 852 and an edge portion 854 and has opposing faces 856, 858. The body portion 852 and the edge portion 854 define a panel cavity 860, and the edge portion 854 may define one or more openings 864 providing access to the panel cavity 860. In certain embodiments, the edge portion 854 has a thickness such that the edge portion 854 can be positioned within a channel 120 of the strut 112 when the panel assembly 806 is assembled. The body portion 852 has a thickness that is greater than the edge portion 854. As best illustrated in FIG. 10, in some embodiments, the thickness of the body portion 852 is less than the thickness of the strut 112 such that the hollow panel 850 is recessed from the opposing faces of the strut 112. The reduced thickness of the body portion 852 relative to the strut 112 may provide improved protection and support for the panels 850 assembled with the strut 112.

An insulating material 862 (or other material as desired) is optionally provided within the panel cavity 860, although the insulating material 862 may be omitted in other embodiments. Optionally, the insulating material 862 is provided in the portion of the panel cavity 860 defined by the body portion 852 and is omitted from the portion of the panel cavity 860 defined by the edge portion 854. In other embodiments, the insulating material 862 may be provided in the edge portion 854. When included, the insulating material 862 may be various types of insulating materials as desired, and may be provided to improve thermal and/or acoustical insulation. In some non-limiting embodiments, the insulating material 862 is foam insulation and/or closed cell insulation.

When included, the hollow panels 850 may reduce the weight of the containment system 100 (e.g., when the panel cavities 860 are not filled) and/or may allow for the containment system 100 to have improved characteristics by allowing a material to be within the panel cavity 860. As a non-limiting example, the hollow panels 850 may allow for improved thermal and/or acoustical insulating properties while reducing the weight of the containment system 100.

Door Assemblies

As mentioned, the containment system 100 may optionally include one or more door assemblies 110. In some embodiments, the containment system 100 may include door assemblies such as those described in the '278 Application. In other embodiments, at least one door assembly 110 may be a door assembly 1110 as illustrated in FIGS. 11-14 and/or a door assembly 1510 as illustrated in FIGS. 15-22.

Referring to FIGS. 11-14, the door assembly 1110 is a hinged door assembly that includes a door 1166, a frame 1168, at least one hinge 1170, and at least one door seal 1172. In various embodiments, the door 1166 and/or the frame 1168 may include features similar to the panel assemblies 106 and may each include at least one strut 112, other frame members, panels (e.g., including but not limited to the hollow panels 850), combinations thereof, or other features as desired.

In the embodiment of FIGS. 11-14, the frame 1168 includes a panel 1150 that is vertically adjustable such that the height of the frame 1168 is vertically adjustable. The frame 1168 includes opposing side frame members 1174A-B and a cross member 1183 (another type of frame member) that define an opening 1185 (see FIG. 15) in the frame 1168 that the door 1166 may selectively cover or provide access to depending on a position of the door 1166. In certain embodiments, each side frame member 1174A-B and the cross member 1183 of the frame 1168 includes at least one strut 112.

The door 1166 in FIGS. 11-14 includes two panels 1150, although the number of panels 1150 should not be considered limiting. Moreover, the panels 1150 used for the door 1166 need not be the same as the panel 1150 of the frame 1168. The panels may be similar to those previously discussed and may be constructed from materials that are rigid or semi-rigid, may be transparent, translucent, opaque, have other optical finishes as desired, or a combination thereof, may include feature(s) related to thermal and/or acoustical insulation, and/or may include other features as desired. The door 1166 may optionally include a gripping feature 1176 such as a knob, handle, latch, or other feature that a user can selectively grab or grasp when using the door. In the embodiment of FIGS. 11-14, the gripping feature 1176 is a knob 1177. In other embodiments, the gripping feature 1176 may be omitted and the door 1166 may be a push door without any additional features. In the embodiment illustrated, the gripping feature 1176 is provided proximate to an edge of the door 1166 that is opposite from the edge of the door 1166 with the hinges 1170, however, in other embodiments the gripping feature 1176 may be provided at various locations as desired. Optionally, the door 1166 may include a closing assist feature 1178 to improve control of the door 1166 when the door 1166 is opened or closed. Closing assist features 1178 may include, but are not limited to, pneumatic door closers, spring members, other biasing members, and/or other features as desired.

The door assembly 1110 includes at least one door hinge 1170 that is provided on or proximate to an edge of the door 1166. In the embodiment of FIGS. 11-14, the door assembly 1110 includes two hinges 1170A-B. The door 1166 and at least one door hinge 1170 may be arranged and attached relative to the frame 1168 such that the door 1166 is a left side door or a right side door, and such that the door 1166 may open inwards into the containment area 102 or outwards into the external environment 104.

Figure 12:
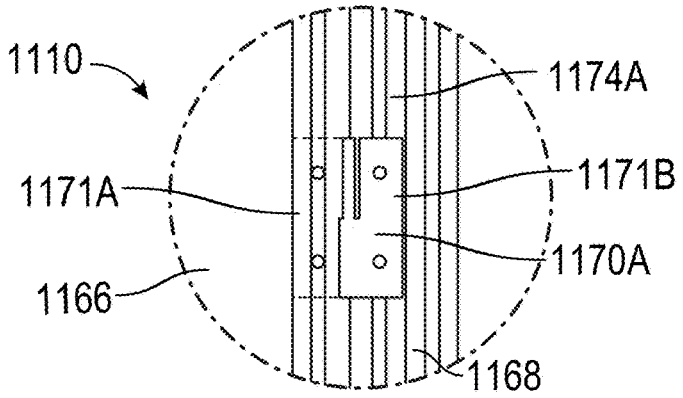
FIG. 12 is a front view of a portion of the door assembly of FIG. 11.
Figure 14:
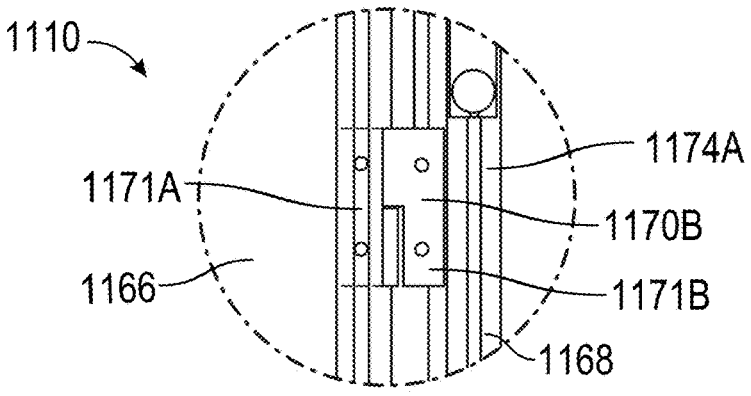
FIG. 14 is a front view of another portion of the door assembly of FIG. 11.

As best illustrated in FIGS. 12 and 14, each hinge 1170A-B includes two hinge portions 1171A-B. In certain embodiments, one hinge portion 1171A may be secured to the door 1166 via various suitable mechanisms as desired, including but not limited to by inserting the hinge portion 1171A into a channel 120 of a strut 112 of the door 1166, having fasteners that engage the channel 120 of the strut 112 while the hinge portion 1171A itself is outside of the channel 120 of the strut 112, and/or as otherwise desired. The other hinge portion 1171B may be secured to one of the side frame members 1174A-B of the frame 1168 depending on the desired orientation of the door 1166 via various mechanisms as desired. In certain embodiments, the hinge portion 1171B may be secured to the frame 1168 such that the hinge portion 1171B is within the containment area 102 or outside of the containment area 102 (i.e., in the external environment 104). In some non-limiting embodiments, the hinge portion 1171 may be secured to the frame 1168 by inserting the hinge portion 1171B into a channel 120 of a strut 112 of one of the side frame members 1174A-B of the frame 1168, having fasteners that engage the channel 120 of the strut 112 while the hinge portion 1171B itself is outside of the channel 120 of the strut 112, and/or as otherwise desired.

Figure 11:
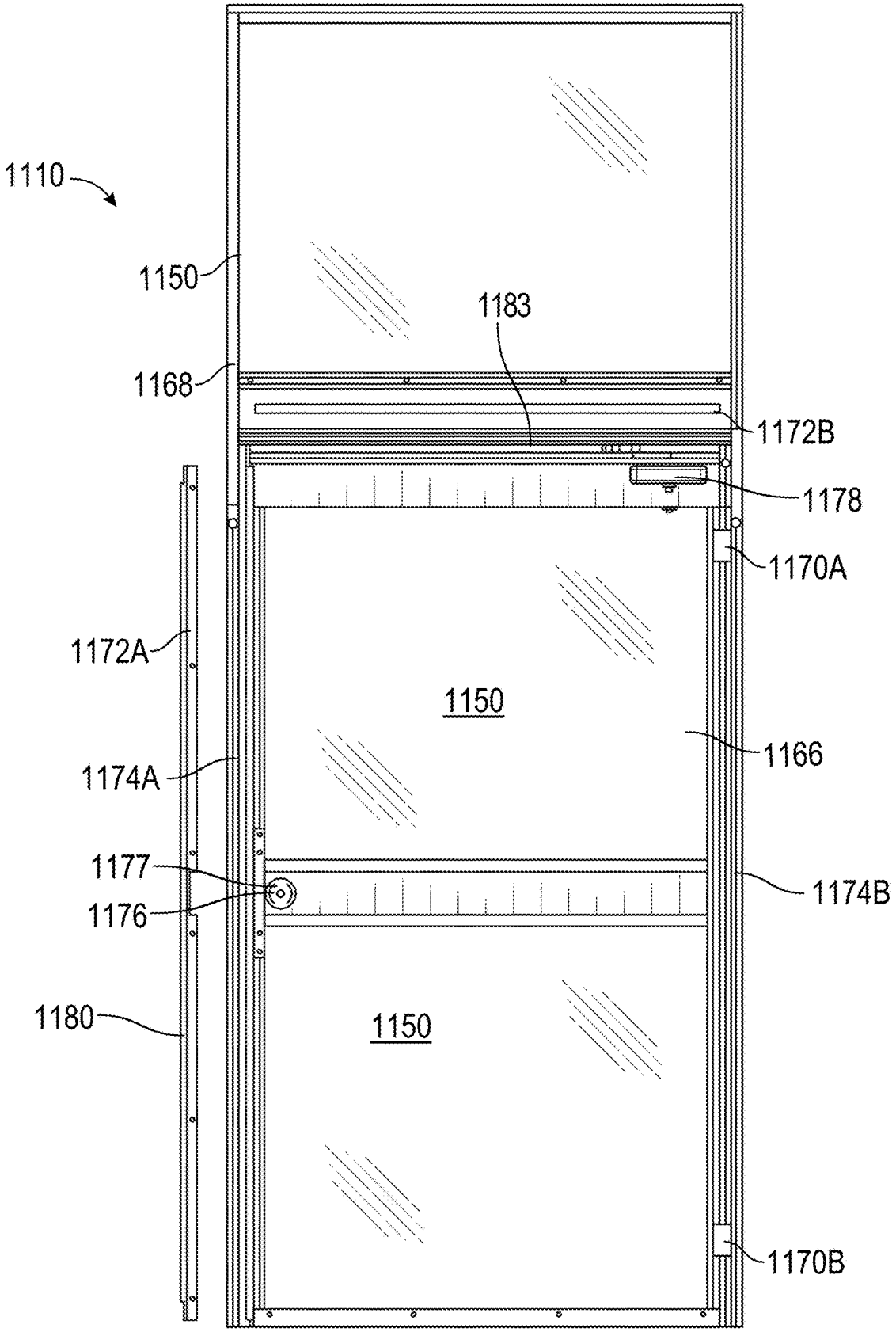
FIG. 11 is a front view of a door assembly for the containment system of FIG. 1 according to certain embodiments.
Figure 13:
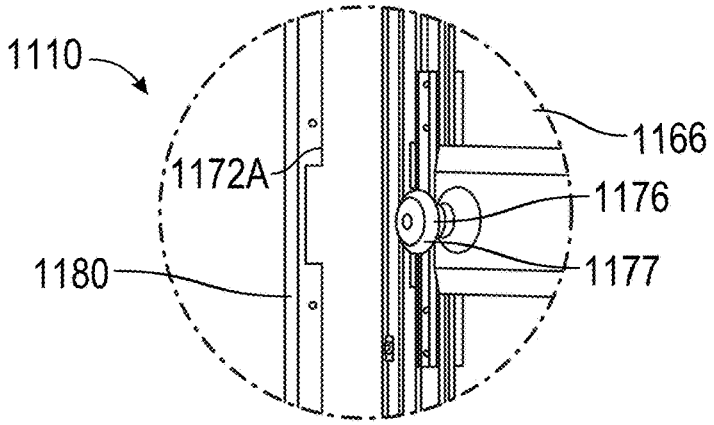
FIG. 13 is a perspective view of another portion of the door assembly of FIG. 11.

As best illustrated in FIGS. 11 and 13, in certain embodiments, the door assembly 1110 includes at least one door seal 1172, and in certain embodiments, the door assembly 1110 includes more than one door seal 1172. In the embodiment of FIGS. 11-14, the door assembly 1110 includes one door seal 1172A provided along the side of the frame 1168 opposite from the hinges 1170 and another door seal 1172B along the cross member 1183. The door seals 1172 may be various suitable devices or materials for selectively forming a seal between the door 1166 and the frame 1168 at least when the door is in the closed position. In some non-limiting embodiments, the door seals 1172 may be constructed from a rubber or a polymer. Optionally, the door seals 1172 may extend partially into the opening defined by the frame 1168 such that the door seals 1172 define a stop for the door 1166 (i.e., the door 1166 cannot be swung completely through the opening in the frame 1168).

In some cases, the door seals 1172 include a tab portion 1180 (or other suitable feature) that is selectively insertable into a channel 120 of the struts 112 of the frame 1168 to position ad secure the door seals 1172 relative to the frame 1168. In other embodiments, the door seals 1172 need not be inserted into the channels 120 of the struts 112 of the frame 1168, and they may instead be secured to the frame 1168 via various other mechanisms as desired. In further embodiments, the door seals 1172 may be secured to the door 1166 rather than the frame 1168 such that the door seals 1172 are movable with the door 1166. In these embodiments, the door seals 1172 may selectively contact the portion of the frame 1168 defining the door opening to selectively form the seal between the door 1166 and the frame 1168. When the door seals 1172 are secured to the door 1166, the tab portions 1180 may be inserted into a channel 120 of the struts 112 of the door 1166 or via other mechanisms as desired.

Figure 15:
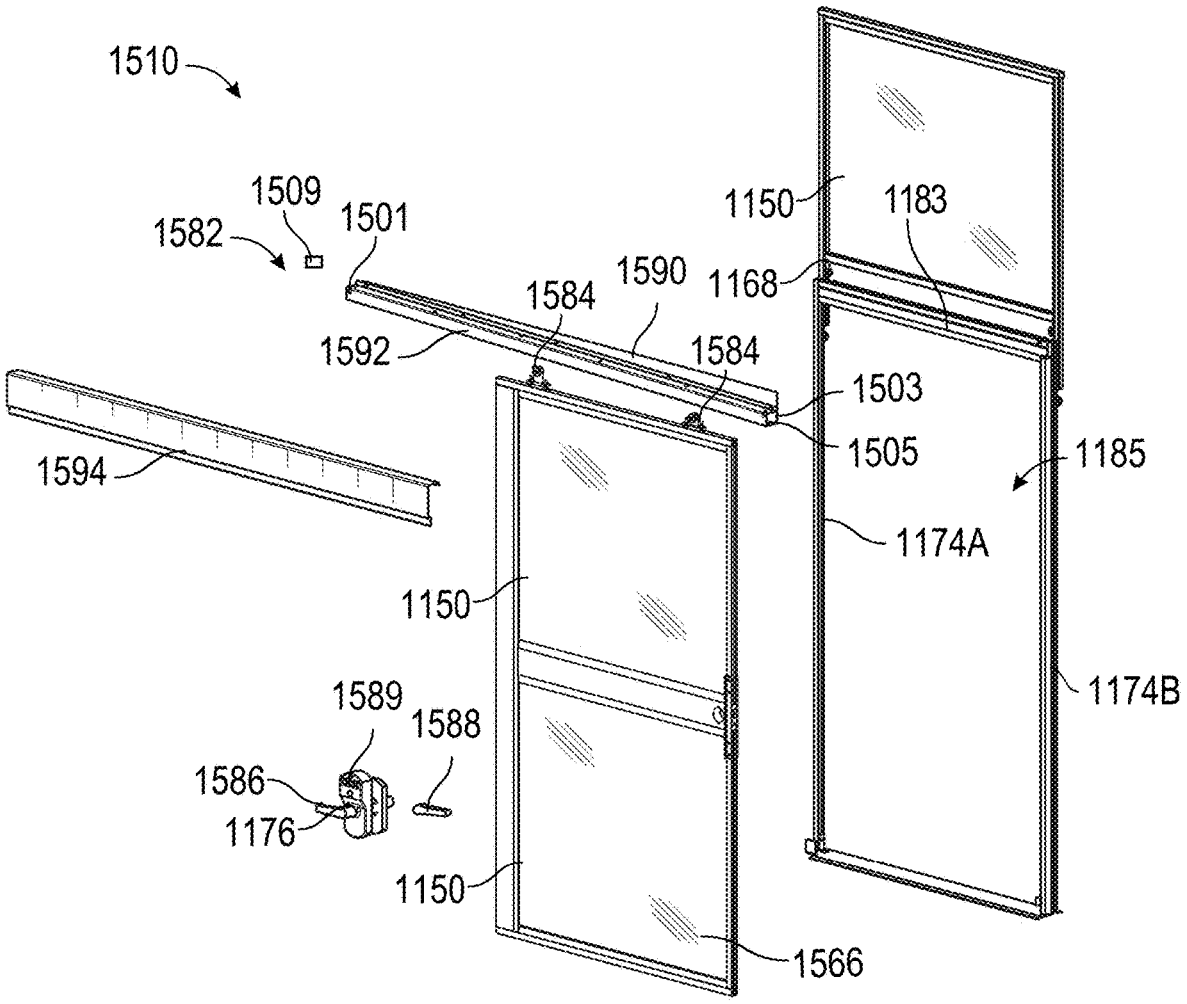
FIG. 15 is perspective exploded view of a door assembly for the containment system of FIG. 1 according to certain embodiments.

Referring to FIGS. 15-22, another example of a door assembly 1510 that can be used with the containment system 100 is illustrated. Compared to the door assembly 1110, the door assembly is a sliding or rolling door assembly. As best illustrated in FIG. 15, similar to the door assembly 1110, the door assembly 1510 includes a door 1566 and the frame 1168. Compared to the door assembly 1110, the door assembly 1510 includes a track assembly 1582 and at least one door carriage 1584. While not illustrated, similar to the door assembly 1110, the door assembly 1510 may optionally include various seals or sealing members.

As best illustrated in FIGS. 15, 16, 20, and 22, the door 1566 may be substantially similar to the door 1166 and includes two panels 1150, although the number of panels 1150 on the door 1566 should not be considered limiting.

Figure 16:
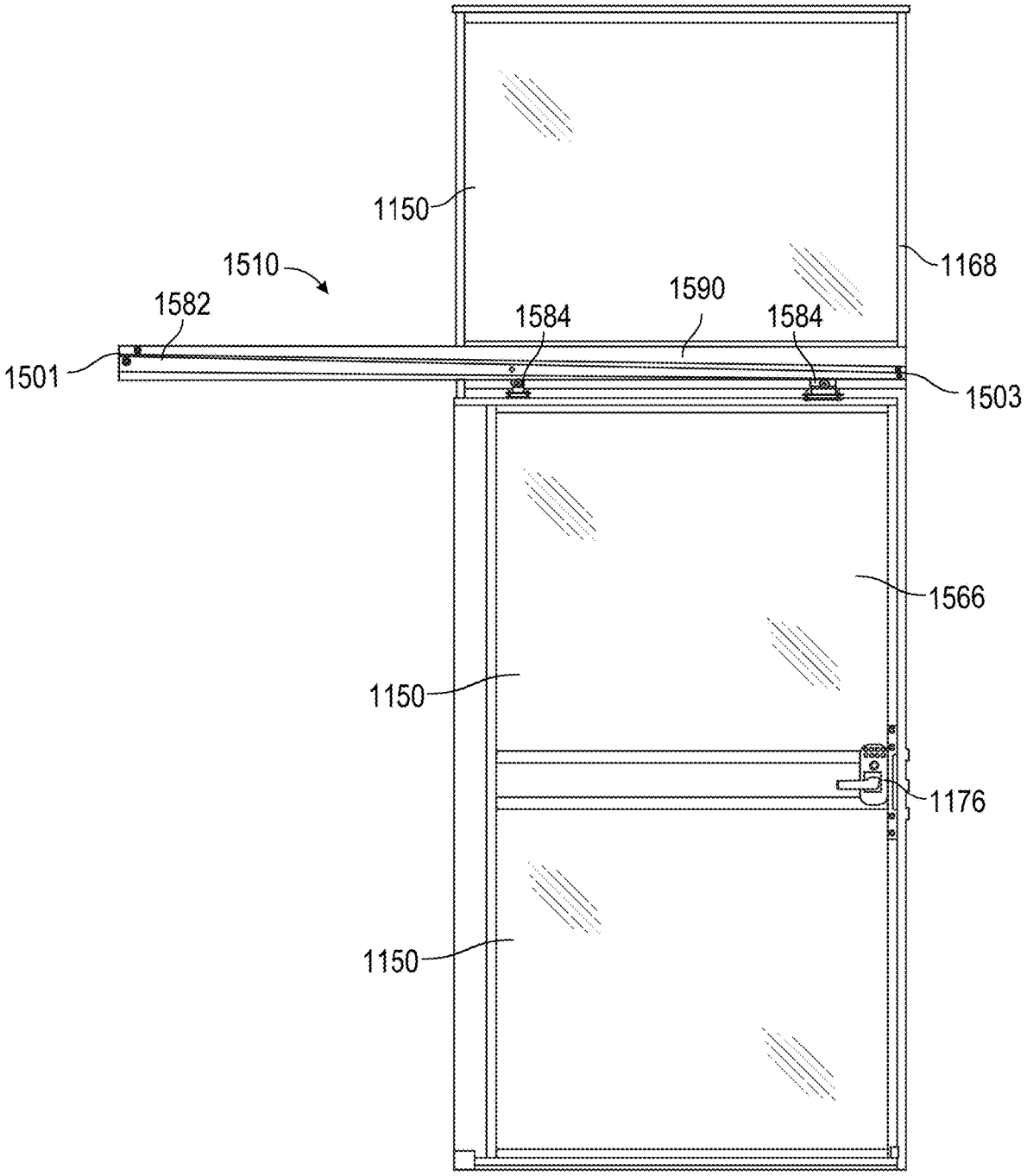
FIG. 16 is a front view of the door assembly of FIG. 15.
Figure 22:
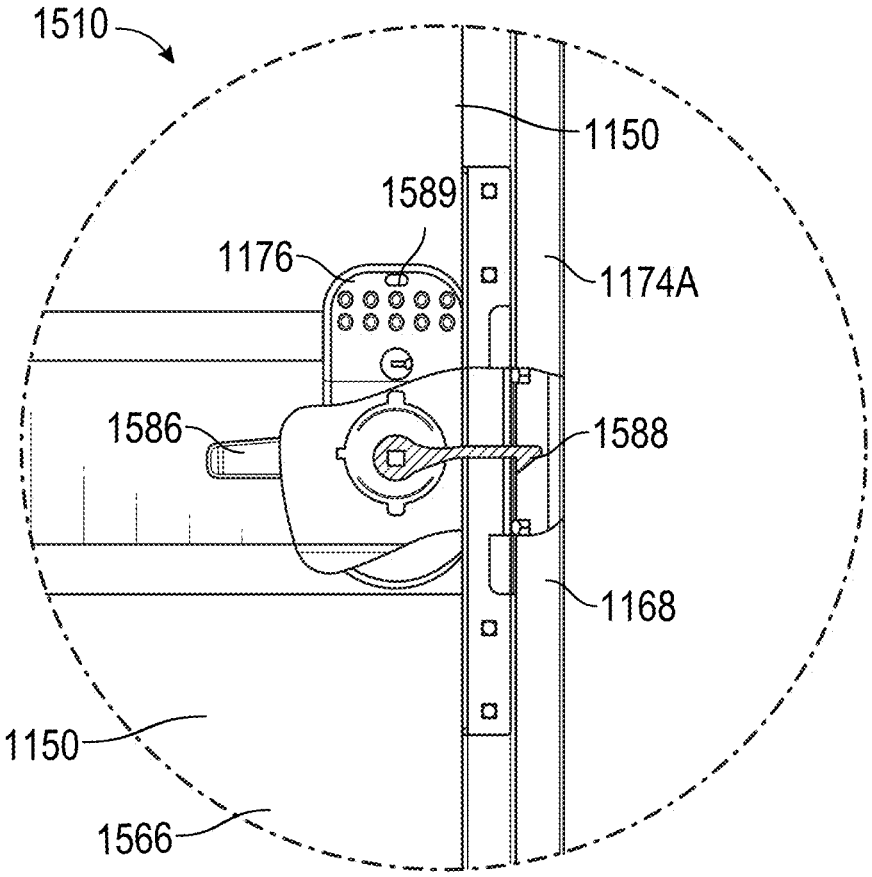
FIG. 22 is a front view of a portion of the door assembly and panel assembly of FIG. 20 taken from circle 22 in FIG. 20 and with portions of the door assembly removed.

Compared to the door 1166 and as best illustrated in FIGS. 15, 16, and 22, the gripping feature 1176 of the door 1566 is a handle 1586 that can be actuated such that a latch 1588 selectively engages or disengages the frame 1168. The gripping feature 1176 also includes a security feature 1589, which may be a keypad, lock, keyhole, or other suitable device or feature as desired to selectively control whether the door may be locked or unlocked.

Referring to FIGS. 15-19, the track assembly 1582 includes a support 1590, a track 1592, and optionally a cover 1594. The cover 1594, when included, may cover and/or conceal the track 1592 and/or the support 1590. In some embodiments, the support 1590, the track 1592, and/or the cover 1594 may be monolithically or integrally formed as a single component, although in other embodiments the support 1590, the track 1592, and/or the cover 1594 are separate components that are secured together via various suitable mechanisms as desired.

Figure 19:
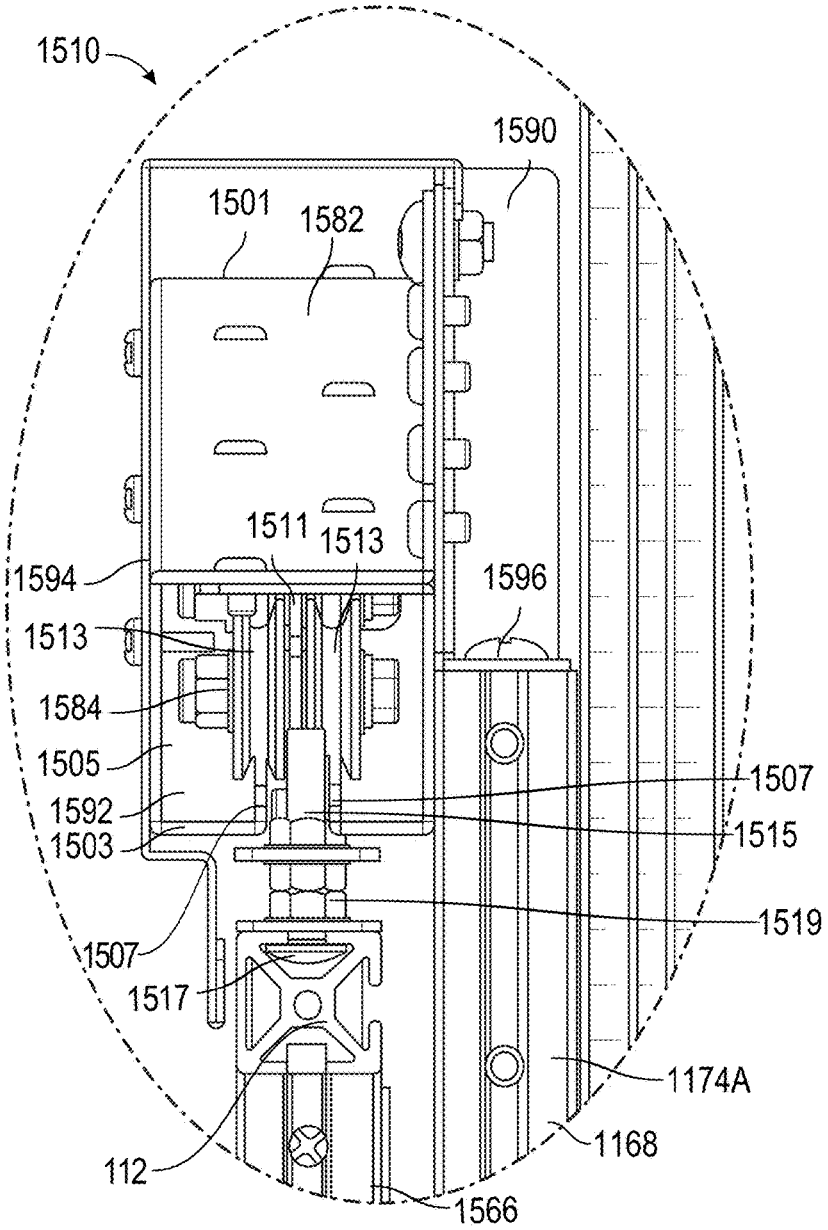
FIG. 19 is a side view of a portion of the door assembly taken from circle 19 in FIG. 18.
Figure 20:
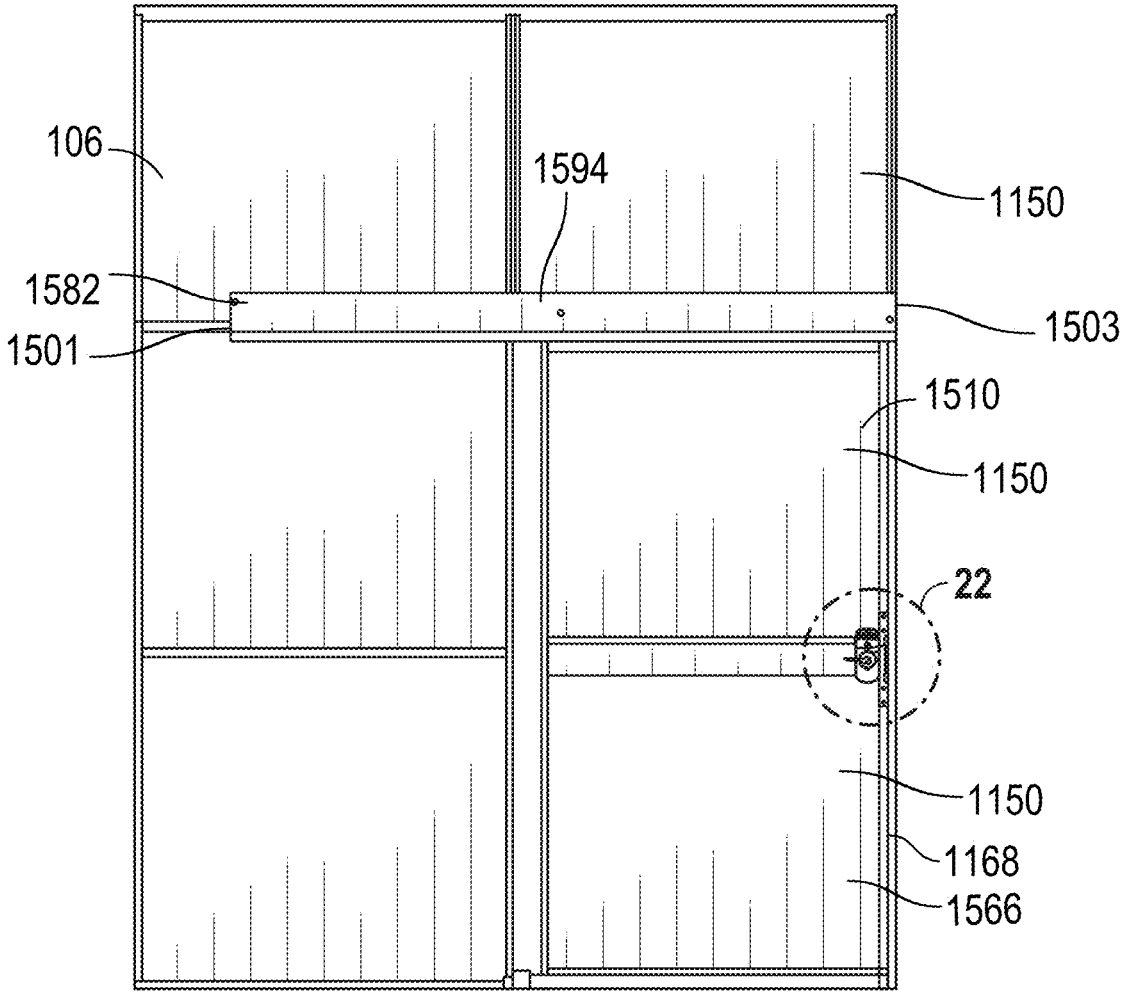
FIG. 20 is a front view of the door assembly of FIG. 15 with a panel assembly.
Figure 21:
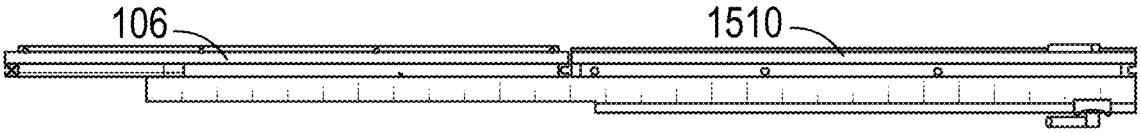
FIG. 21 is a top view of the door assembly and panel assembly of FIG. 20.

As best illustrated in FIG. 19, the support 1590 is secured to the frame 1168. Optionally, the support 1590 may be at least partially supported by an adjacent component (e.g., an adjacent panel assembly 106 as illustrated in FIG. 20). In certain embodiments, the support 1590 is secured to the frame 1168 via fasteners 1596 that engage a channel 120 of the strut 112 of the cross member 1183, although in other embodiments the support 1590 may be secured via other mechanisms and/or at other locations as desired.

The track 1592 is secured to the support 1590 and extends across a width of the opening 1185 of the frame 1168 and includes a first end 1501, a second end 1503, and a track surface 1505 extending from the first end 1501 to the second end 1503. In certain embodiments, a vertical height of the first end 1501 is different from a vertical height of the second end 1503 such that the track surface 1505 is sloped downwards from the first end 1501 towards the second end 1503 or vice versa. In the embodiment of FIGS. 15-22, the first end 1501 is vertically above the second end 1503 such that the track surface 1505 is sloped downwards from the first end 1501 to the second end 1503. In certain embodiments, the end of the track 1592 that is at the vertically lower position is the end of the track 1592 that is at the opening 1185 and the opposing end of the track 1592 is spaced apart from the opening 1185. The sloped track surface 1505 may bias the door 1566 towards the closed position in which the door 1566 covers the opening 1185. Optionally, the sloped track surface 1505 may allow for the door 1566 to be self-closing.

Figure 17:
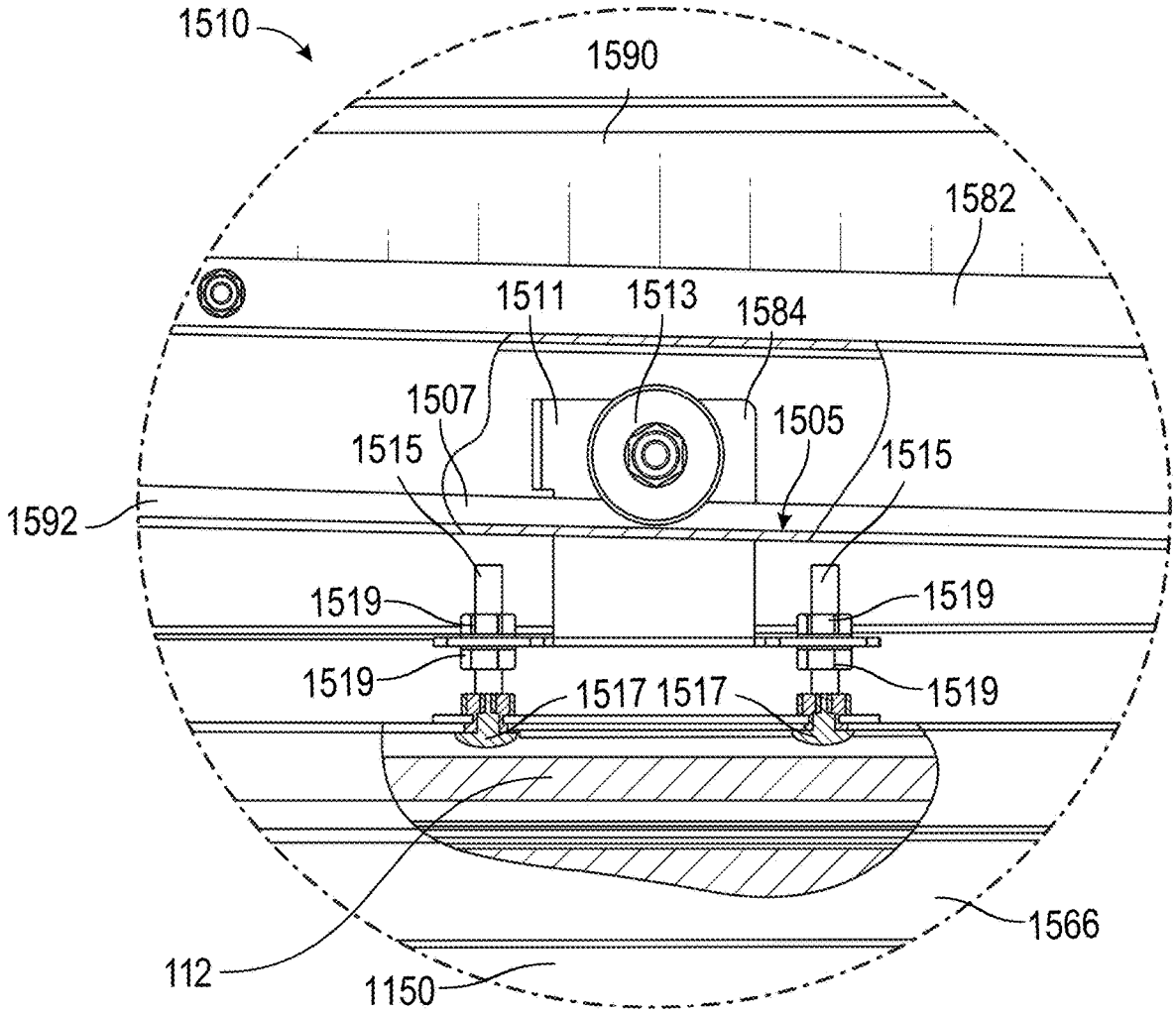
FIG. 17 is a front view of a portion of the door assembly of FIG. 15 with portions of the door assembly removed.
Figure 18:
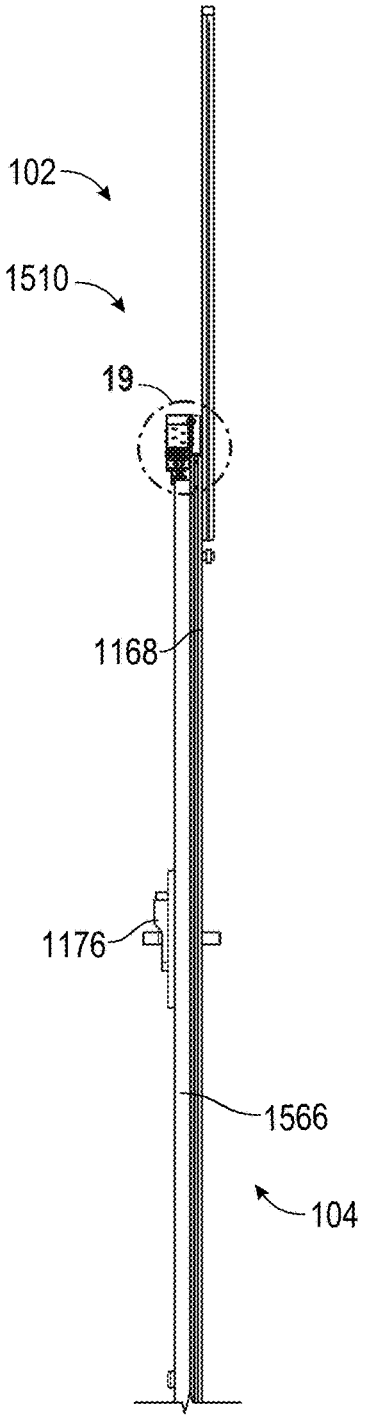
FIG. 18 is a side view of the door assembly of FIG. 15.

Optionally, the track 1592 is enclosed along its length from the first end 1501 to the second end 1503 to protect the door carriage 1584 as the door carriage 1584 moves along the track 1592. In other embodiments, the track 1592 need not be enclosed. Optionally, and as best illustrated in FIGS. 17 and 19, the track 1592 includes rails 1507 extending upwards from the track surface 1505. The rails 1507 may provide improved contact and guidance of the door carriage 1584 along the track 1592 between the first end 1501 and the second end 1503. Optionally, the track 1592 includes a stopper 1509 at the end of the track 1592 that is at the vertically higher position to selectively retain the door 1566 in an open position. In the embodiment of FIGS. 15-22, the stopper 1509 is provided at the first end 1501. The stopper 1509 may be various suitable devices or mechanisms for selectively retaining the door 1566 at the higher end of the track 1592. In the embodiment of FIGS. 15-22, the stopper 1509 is a magnet that selectively engages the door carriage 1584 to selectively retain the door 1566 at the higher end of the track 1592 and in the open position.

As best illustrated in FIGS. 17 and 19, the door carriage 1584 supports the door 1566 on the track assembly 1582 such that the door 1566 is movable relative to the opening 1185. While two door carriages 1584 are illustrated, any number of door carriages 1584 may be utilized, including a single door carriage 1584 or more than two door carriages 1584. Each door carriage 1585 includes a support 1511, at least one roller 1513, and at least one door connector 1515.

The support 1511 connects the at least one roller 1513 with the at least one door connector 1515 and may have various shapes or configurations as desired. The at least one roller 1513 may be various types of rollers suitable for engaging the track surface 1505 and optionally the rails 1507 of the track 1592, including but not limited to wheels, bearings, rollers, and/or other features as desired. In the embodiment of FIGS. 15-22, the door carriage 1584 includes two rollers 1513, although any number of rollers 1513 may be utilized. Moreover, in other embodiments, the at least one roller 1513 may be omitted and the door carriage 1584 may include various other mechanisms such that the door carriage 1584 is linearly movable along the track surface 1505 and/or the rails 1507.

The at least one door connector 1515 connects the door 1566 with the support 1511. In the embodiment illustrated, the door carriage 1584 includes two door connectors 1515, although any number of door connectors 1515 may be utilized. In certain embodiments, and as best illustrated in FIG. 17, the door connectors 1515 include a head portion 1517 that is selectively positioned in a channel 120 of the strut 112 of the door 1566 to connect the door 1566 with the support 1511. In other embodiments, the door connectors 1515 may be connected to the door 1566 via various other mechanisms as desired.

In some embodiments, the door connectors 1515 are vertically adjustable such that a distance between the door 1566 and the support 1511 is adjustable. In some cases, the vertically adjustable door connectors 1515 may allow for the door 1566 to remain in a generally horizontal configuration while the door carriage 1584 moves along the sloped track surface 1505. The vertical adjustment of the door 1566 may allow for improved control of the door 1566 relative to the track assembly 1582 and/or the frame 1168 such that the door 1566 has desired clearances, engagement with other portions of the containment system 100, etc. Vertically adjustable door connectors 1515 may also allow for the door 1566 to be supported in a non-horizontal configuration (e.g., if the floor of the containment area is not perfectly flat). In embodiments where the door connectors 1515 are bolts or other connectors, the door connectors 1515 may optionally be vertically adjustable by rotating the door connectors 1515 relative to the support 1511. When vertically adjustable, the door connectors 1515 may include one or more stoppers 1519 that retain the door connectors 1515 (and thus the door 1566) at the desired vertical position relative to the support 1511. In other embodiments, the door connectors 1515 need not be vertically adjustable.

Illustrations

A collection of exemplary embodiments are provided below, including at least some explicitly enumerated as "Illustrations" providing additional description of a variety of example embodiments in accordance with the concepts described herein. These illustrations are not meant to be mutually exclusive, exhaustive, or restrictive; and the disclosure not limited to these example illustrations but rather encompasses all possible modifications and variations within the scope of the issued claims and their equivalents.

Illustration 1. A containment system for separating a containment area from an external environment, the containment system comprising: a flexible corner assembly configured to join adjacent panel assemblies of the containment system, wherein the flexible corner assembly comprises a corner body comprising: a first face; a second face opposite from the first face; a first projection extending outwards from the first face and extending along a length of the corner body; a second projection extending outwards from the second face in a direction opposite the first projection and extending along the length of the corner body, wherein the second projection is offset from the first projection in a lateral direction on the corner body; and at least one bending groove defined in the corner body between the first projection and the second projection in the lateral direction, wherein the at least one bending groove extends along the length of the corner body, and wherein the corner body is bendable via the at least one bending groove such that an orientation of the first projection relative to the second projection is adjustable.

Illustration 2. The containment system of any preceding or subsequent illustrations or combination of illustrations, wherein the at least one bending groove is a first bending groove defined in the first face, wherein the corner body further comprises a second bending groove defined in the second face, wherein the second bending groove extends along the length of the corner body and is between the first bending groove and the second projection in the lateral direction, and wherein the corner body is bendable via the second bending groove.

Illustration 3. The containment system of any preceding or subsequent illustrations or combination of illustrations, wherein the corner body is integrally formed from rubber.

Illustration 4. The containment system of any preceding or subsequent illustrations or combination of illustrations, wherein the flexible corner assembly further comprises a cover, the cover comprising: a first side edge extending along a length of the cover, wherein the first side edge comprises a first positioning rib; a second side edge opposite from the first side edge and extending along the length of the cover, wherein the second side edge comprises a second positioning rib; and a spacer extending outwards from the cover between the first side edge and the second side edge, wherein the first projection is configured to be positioned in a first channel of a first panel assembly of the adjacent panel assemblies, the first positioning rib is configured to be positioned in a second channel of the first panel assembly, the second projection is configured to be positioned in a first channel of a second panel assembly of the adjacent panel assemblies, and the second projection is configured to be positioned in a second channel of the second channel assembly.

Illustration 5. The containment system of any preceding or subsequent illustrations or combination of illustrations, further comprising the adjacent panel assemblies, wherein the adjacent panel assemblies comprises: a first panel assembly comprising a channel extending along a length of the first panel assembly; and a second panel assembly comprising a channel extending along a length of the second panel assembly, wherein the first projection of the flexible corner assembly is received within the channel of the first panel assembly and the second projection of the flexible corner assembly is received within the channel of the second panel assembly, and wherein an orientation of the first panel assembly relative to the second panel assembly is adjustable via the flexible corner assembly.

Illustration 6. The containment system of any preceding or subsequent illustrations or combination of illustrations, wherein the first panel assembly and the second panel assembly are adjustable between a neutral orientation and an angled orientation, wherein: in the neutral orientation, the first panel assembly is parallel to the second panel assembly and the corner body is unbent; and In the angled orientation, the first panel assembly extends at a non-zero angle relative to the second panel assembly and the corner body is bent and at least a first portion of the corner body extends at a non-zero angle relative to a second portion of the corner body.

Illustration 7. The containment system of any preceding or subsequent illustrations or combination of illustrations, wherein the non-zero angle is less than or equal to 150 degrees from the neutral orientation.

Illustration 8. The containment system of any preceding or subsequent illustrations or combination of illustrations, wherein: the channel of the first panel assembly is a first channel, and the first panel comprising a channel extending along a length of the first panel assembly; and a second panel assembly comprising a channel extending along a length of the second panel assembly, wherein the first projection of the flexible corner assembly is received within the channel of the first panel assembly and the second projection of the flexible corner assembly is received within the channel of the second panel assembly, and wherein an orientation of the first panel assembly relative to the second panel assembly is adjustable via the flexible corner assembly.

Illustration 9. A containment system for separating a containment area from an external environment, the containment system comprising a panel assembly, the panel assembly comprising: a strut comprising a channel extending along a length of the strut; and a panel comprising a body portion and an edge portion, wherein the body portion and the edge portion define a panel cavity, wherein the edge portion is at least partially received within the channel of the strut, wherein a width of the edge portion is less than a width of the body portion, and wherein the width of the body portion is less than a width of the strut.

Illustration 10. The containment system of any preceding or subsequent illustrations or combination of illustrations, further comprising an insulating material within the panel cavity.

Illustration 11. The containment system of any preceding or subsequent illustrations or combination of illustrations, wherein the insulating material comprises an insulation foam.

Illustration 12. The containment system of any preceding or subsequent illustrations or combination of illustrations, wherein the edge portion defines an opening to the panel cavity.

Illustration 13. The containment system of any preceding or subsequent illustrations or combination of illustrations, wherein the panel comprises metal.

Illustration 14. The containment system of any preceding or subsequent illustrations or combination of illustrations, wherein the panel assembly is a first panel assembly and the channel is a first channel, wherein strut further comprises a second channel opposite from the first channel and extending along the length of the strut, and wherein the containment system further comprises: a second panel assembly comprising a channel extending along a length of the second panel assembly; and a flexible corner assembly joining the first panel assembly and the second panel assembly, wherein the flexible corner assembly comprises a corner body comprising: a first face; a second face opposite from the first face; a first projection extending outwards from the first face and extending along a length of the corner body, wherein the first projection is positioned in the channel of the second panel assembly; a second projection extending outwards from the second face in a direction opposite the first projection and extending along the length of the corner body, wherein the second projection is offset from the first projection in a lateral direction on the corner body, and wherein the second projection is positioned in the second channel of the first panel assembly; and at least one bending groove defined in the corner body between the first projection and the second projection in the lateral direction, wherein the at least one bending groove extends along the length of the corner body, and wherein the corner body is bendable via the at least one bending groove such that an orientation an orientation of the first panel assembly relative to the second panel assembly is adjustable via the flexible corner assembly.

Illustration 15. A containment system for separating a containment area from an external environment, the containment system comprising: a door frame defining an opening; a track extending across a width of the opening, wherein the track comprises a first end and a second end, wherein a vertical height of the first end is different from a vertical height of the second end such that the track is sloped downwards towards the first end or the second end; and a door carriage configured to support a door, wherein the door carriage comprises: at least one roller that is movable along the track; a support; and at least one vertical adjuster extending from the support and configured to engage the door, wherein the at least one vertical adjuster is vertically adjustable such that a distance between the door and the support is adjustable.

Illustration 16. The containment system of any preceding or subsequent illustrations or combination of illustrations, further comprising the door, wherein the door comprises: a top strut comprising a first channel and a second channel opposite from the first channel; and a panel, wherein the at least one vertical adjuster is at least partially received within the first channel, and wherein the panel is at least partially received within the second channel.

Illustration 17. The containment system of any preceding or subsequent illustrations or combination of illustrations, wherein the panel comprises a body portion and an edge portion, wherein the body portion and the edge portion define a panel cavity, wherein the edge portion is at least partially received within the second channel of the top strut, wherein a width of the edge portion is less than a width of the body portion, and wherein the width of the body portion is less than a width of the top strut.

Illustration 18. The containment system of any preceding or subsequent illustrations or combination of illustrations, wherein the track comprises a base and at least one rail extending from the base, and wherein the at least one roller is movable along the rail.

Illustration 19. The containment system of any preceding or subsequent illustrations or combination of illustrations, wherein the track is enclosed between the first end and the second end.

Illustration 20. The containment system of any preceding or subsequent illustrations or combination of illustrations, further comprising the door, wherein the vertical position of the first end of the track is above the vertical position of the second end of the track, wherein the first end is spaced apart from the opening such the opening is at least partially unobstructed by the door when the door is positioned proximate to the first end, and wherein the track further comprises a stopper proximate to the first end that is configured to selectively engage the door carriage.

The above-described aspects are merely possible examples of implementations, merely set forth for a clear understanding of the principles of the present disclosure. Many variations and modifications can be made to the above-described example(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed is:

1. A containment system for separating a containment area from an external environment, the containment system comprising:

a flexible corner assembly configured to join adjacent panel assemblies of the containment system, wherein the flexible corner assembly comprises a corner body comprising:

a first face;

a second face opposite from the first face;

a first projection extending outwards from the first face and extending along a length of the corner body;

a second projection extending outwards from the second face in a direction opposite the first projection and extending along the length of the corner body, wherein the second projection is offset from the first projection in a lateral direction on the corner body; and at least one bending groove defined in the corner body between the first projection and the second projection in the lateral direction, wherein the at least one bending groove extends along the length of the corner body, and wherein the corner body is bendable via the at least one bending groove such that an orientation of the first projection relative to the second projection is adjustable, wherein the at least one bending groove is a first bending groove defined in the first face, wherein the corner body further comprises a second bending groove defined in the second face, wherein the second bending groove extends along the length of the corner body and is between the first bending groove and the second projection in the lateral direction, and wherein the corner body is bendable via the second bending groove.

2. The containment system of claim 1, wherein the corner body is integrally formed from rubber.

3. The containment system of claim 1, wherein the flexible corner assembly further comprises a cover, the cover comprising:

a first side edge extending along a length of the cover, wherein the first side edge comprises a first positioning rib;

a second side edge opposite from the first side edge and extending along the length of the cover, wherein the second side edge comprises a second positioning rib; and a spacer extending outwards from the cover between the first side edge and the second side edge, wherein the first projection is configured to be positioned in a first channel of a first panel assembly of the adjacent panel assemblies, the first positioning rib is configured to be positioned in a second channel of the first panel assembly, the second projection is configured to be positioned in a first channel of a second panel assembly of the adjacent panel assemblies, and the second projection is configured to be positioned in a second channel of the second channel assembly.

4. The containment system of claim 1, further comprising the adjacent panel assemblies, wherein the adjacent panel assemblies comprises:

a first panel assembly comprising a channel extending along a length of the first panel assembly; and a second panel assembly comprising a channel extending along a length of the second panel assembly, wherein the first projection of the flexible corner assembly is receivable within the channel of the first panel assembly and the second projection of the flexible corner assembly is receivable within the channel of the second panel assembly, and wherein an orientation of the first panel assembly relative to the second panel assembly is adjustable via the flexible corner assembly.

5. The containment system of claim 4, wherein:

the channel of the first panel assembly is a first channel, and the first panel comprises a channel extending along a length of the first panel assembly; and a second panel assembly comprises a channel extending along a length of the second panel assembly, wherein the first projection of the flexible corner assembly is receivable within the channel of the first panel assembly and the second projection of the flexible corner assembly is receivable within the channel of the second panel assembly, and wherein an orientation of the first panel assembly relative to the second panel assembly is adjustable via the flexible corner assembly.

6. The containment system of claim 4, wherein the first panel assembly and the second panel assembly are adjustable between a neutral orientation and an angled orientation, wherein:

in the neutral orientation, the first panel assembly is parallel to the second panel assembly and the corner body is unbent; and in the angled orientation, the first panel assembly extends at a non-zero angle relative to the second panel assembly and the corner body is bent and at least a first portion of the corner body extends at a non-zero angle relative to a second portion of the corner body.

7. The containment system of claim 6, wherein the non-zero angle is less than or equal to 150 degrees from the neutral orientation.

8. A containment system for separating a containment area from an external environment, the containment system comprising:

a flexible corner assembly configured to join adjacent panel assemblies of the containment system, wherein the flexible corner assembly comprises a corner body comprising:

a first face;

a second face opposite from the first face;

a first projection extending outwards from the first face and extending along a length of the corner body;

a second projection extending outwards from the second face in a direction opposite the first projection and extending along the length of the corner body, wherein the second projection is offset from the first projection in a lateral direction on the corner body; and at least one bending groove defined in the corner body between the first projection and the second projection in the lateral direction, wherein the at least one bending groove extends along the length of the corner body, and wherein the corner body is bendable via the at least one bending groove such that an orientation of the first projection relative to the second projection is adjustable, wherein the flexible corner assembly further comprises a cover, the cover comprising:

a first side edge extending along a length of the cover, wherein the first side edge comprises a first positioning rib;

a second side edge opposite from the first side edge and extending along the length of the cover, wherein the second side edge comprises a second positioning rib; and a spacer extending outwards from the cover between the first side edge and the second side edge, wherein the first projection is configured to be positioned in a first channel of a first panel assembly of the adjacent panel assemblies, the first positioning rib is configured to be positioned in a second channel of the first panel assembly, the second projection is configured to be positioned in a first channel of a second panel assembly of the adjacent panel assemblies, and the second projection is configured to be positioned in a second channel of the second channel assembly.

* * * * *